US008356888B2

(12) United States Patent
Takata

(10) Patent No.: US 8,356,888 B2
(45) Date of Patent: Jan. 22, 2013

(54) CHANNEL FORMING METHOD, CHANNEL FORMING BODY, AND ASSEMBLY PARTS OF THE CHANNEL FORMING BODY

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 224 days.

(21) Appl. No.: 12/621,163

(22) Filed: Nov. 18, 2009

(65) Prior Publication Data

US 2010/0122460 A1 May 20, 2010

(30) Foreign Application Priority Data

Nov. 19, 2008 (JP) ..... 2008-296009

(51) Int. Cl.
*B41J 2/17* (2006.01)

(52) U.S. Cl. ..... 347/84; 347/85

(58) Field of Classification Search ..... 347/20, 347/84–87
See application file for complete search history.

(56) References Cited

U.S. PATENT DOCUMENTS 6,481,839 B1 * 11/2002 Ito ..... 347/86
7,108,361 B2 * 9/2006 Kitabatake et al. ..... 347/86
7,303,271 B2 12/2007 Shimizu et al.

FOREIGN PATENT DOCUMENTS

JP 2005-145045 A 6/2005
JP 2005-152691 A 6/2005

OTHER PUBLICATIONS

Japan Patent Office, Notice of Reasons for Rejection for Patent Application No. 2008-296009, mailed Sep. 14, 2010. (partial translation).

* cited by examiner

*Primary Examiner* — Juanita D Jackson
(74) *Attorney, Agent, or Firm* — Baker Botts L.L.P.

(57) ABSTRACT

A channel forming method includes: forming a first member having a fitting groove and a second member which is to be fitted into the fitting groove; fitting the second member into the fitting groove; and joining joint peripheral portions of the first member and the second member by heating from outside the fitted second member, and a channel is foamed by channel grooves formed in a bottom portion of the fitting groove and a facing surface of the second member facing the bottom portion.

8 Claims, 15 Drawing Sheets

Fig. 14A

EMBODIMENT

| | | | | | |
|---|---|---|---|---|---|
| LONG GROOVE | VISCOSITY | 3.0 | mPas | TOLERANCE | |
| | WIDTH | 0.8 | ± | 0.05 | mm |
| | DEPTH | 0.3 | ± | 0.03 | mm |
| | LENGTH | 8.05 | ± | 0.05 | mm |
| SHORT GROOVE | VISCOSITY | 3.0 | mPas | TOLERANCE | |
| | WIDTH | 0.8 | ± | 0.05 | mm |
| | DEPTH | 0.3 | ± | 0.03 | mm |
| | LENGTH | 1.9 | ± | 0.05 | mm |

| | RESISTANCE VALUE kPa/(ml/s) | | | EQUIVALENT RADIUS | | |
|---|---|---|---|---|---|---|
| LONG GROOVE | NOMINAL DIMENSION | MAXIMUM | MINIMUM | NOMINAL DIMENSION | MAXIMUM | MINIMUM |
| | 27.14 | 39.83 | 19.14 | 0.218182 | 0.237712 | 0.198529 |
| | RESISTANCE VALUE kPa/(ml/s) | | | EQUIVALENT RADIUS | | |
| SHORT GROOVE | NOMINAL DIMENSION | MAXIMUM | MINIMUM | NOMINAL DIMENSION | MAXIMUM | MINIMUM |
| | 6.41 | 9.59 | 4.43 | 0.218182 | 0.237712 | 0.198529 |

| | RESISTANCE VALUE kPa/(ml/s) | | |
|---|---|---|---|
| | NOMINAL DIMENSION | MAXIMUM | MINIMUM |
| TOTAL RESISTANCE OF CHOKE PORTIONS | 33.54 | 49.42 | 25.37 |
| MAXIMUM – MINIMUM | **25.86** | | |

Fig. 14B

COMPARATIVE EXAMPLE (HAVING HEAT-WELDED FILM)

| | | | | | |
|---|---|---|---|---|---|
| LONG GROOVE | VISCOSITY | 3.0 | mPas | TOLERANCE | |
| | WIDTH | 0.8 | ± | 0.05 | mm |
| | DEPTH | 0.3 | ± | 0.13 | mm |
| | LENGTH | 8.05 | ± | 0.05 | mm |
| SHORT GROOVE | VISCOSITY | 3.0 | mPas | TOLERANCE | |
| | WIDTH | 0.8 | ± | 0.05 | mm |
| | DEPTH | 0.3 | ± | 0.13 | mm |
| | LENGTH | 1.9 | ± | 0.05 | mm |

| | RESISTANCE VALUE kPa/(ml/s) | | | EQUIVALENT RADIUS | | |
|---|---|---|---|---|---|---|
| LONG GROOVE | NOMINAL DIMENSION | MAXIMUM | MINIMUM | NOMINAL DIMENSION | MAXIMUM | MINIMUM |
| | 27.14 | 167.75 | 9.19 | 0.218182 | 0.285547 | 0.138587 |
| | RESISTANCE VALUE kPa/(ml/s) | | | EQUIVALENT RADIUS | | |
| SHORT GROOVE | NOMINAL DIMENSION | MAXIMUM | MINIMUM | NOMINAL DIMENSION | MAXIMUM | MINIMUM |
| | 6.41 | 40.38 | 2.13 | 0.218182 | 0.285547 | 0.138587 |

| | RESISTANCE VALUE kPa/(ml/s) | | |
|---|---|---|---|
| | NOMINAL DIMENSION | MAXIMUM | MINIMUM |
| TOTAL RESISTANCE OF CHOKE PORTIONS | 33.54 | 208.13 | 11.32 |
| MAXIMUM – MINIMUM | **196.81** | | |

CHANNEL FORMING METHOD, CHANNEL FORMING BODY, AND ASSEMBLY PARTS OF THE CHANNEL FORMING BODY

CROSS REFERENCE TO RELATED APPLICATION

The present application claims priority from Japanese Patent Application No. 2008-296009, filed on Nov. 19, 2008, the disclosure of which is incorporated herein by reference in its entirety.

BACKGROUND OF THE INVENTION

1. Field of the Invention

The present invention relates to a forming method and a forming body of an air discharge channel for discharging air in liquid which is supplied to a jetting head provided in a liquid jetting apparatus such as, for example, an ink-jet printer apparatus, and further relates to assembly parts of the channel forming body.

2. Description of the Related Art

As a printer apparatus of an ink jet type which is an example of a liquid jetting apparatus, there has conventionally been known one adopting a structure in which a jetting head reciprocating while facing a recording paper is supplied with ink from ink cartridges provided in an apparatus body via flexible ink supply tubes (what is called a tube supply type). Some such printer apparatus has channels through which air growing in the middle of the ink supply channels is discharged to the outside, besides channels for supplying the ink.

For example, in an ink jet printer described in U.S. Pat. No. 7,303,271B2 (corresponding to Japanese Patent Application Laid-open No. 2005-145045), these channels are formed by heat-welding a film to a resin-molded member having a groove. Other such channels being in use are a flexible tube manufactured by extrusion molding, a channel formed by welding resin-molded members to each other by ultrasonic vibration, and the like.

However, in the channel formed by heat-welding the resin-molded member and the film as shown in U.S. Pat. No. 7,303,271B2, it is difficult to control an amount of resin melting at the time of heating to a constant value, and when part of a molten resin content enters the groove formed in the resin-molded member, there occurs variation in channel sectional area. Further, since a highly flexible material is generally used as the film, the film deforms according to a change in internal pressure, which also becomes a cause of the occurrence of the variation in channel sectional area. Then, such variation in channel sectional area causes variation in channel resistance.

Here, when it is expected that variation in channel resistance may occur in some channel, a damper for some channel with small resistance has to be increased in size, while a filter and a channel diameter for the other channels with high resistance have to be increased in size. That is, in the channel with a small resistance, a pressure change of the ink or the like flowing inside easily propagates and thus a high-performance damper mechanism is necessary in order to alleviate the pressure change, which as a result necessitates the size increase of the damper. On the other hand, in the channel with a high resistance, it is necessary to make the filter disposed in the middle large or to make the channel diameter large in advance, in order to prevent lack of the supply of the ink or the like. As described above, the variation in channel resistance necessitates the size increase of the whole apparatus.

Besides the above-described channel formed by heat-welding the film to the resin-molded member, there are some other ones used as the channel, and among these, the flexible tube formed by the extrusion molding has a limit in a radius of curvature when it is curved, and it is difficult to bend it, for example, at a right angle, which poses a limit in layout of the channel. Further, though it is possible to divide the tube into a plurality of tubes to connect them by joints, a lot of skill is required for connecting the tubes with a small channel diameter and it is also difficult to ensure airtightness of connection portions.

Further, in the channel formed by welding the resin-molded members by ultrasonic wave, the molten resin content is also likely to enter the channel, which becomes a cause of variation in channel resistance.

SUMMARY OF THE INVENTION

Therefore, it is an object of the present invention to provide a channel forming method, a channel forming body, and assembly parts of the channel forming body which are capable of preventing variation in channel resistance and easily ensuring airtightness.

According to a first aspect of the present invention, there is provided a channel forming method for forming a channel for a fluid, the method including: forming a first member which has a fitting groove and a second member which is to be fitted into the fitting groove; fitting the second member into the fitting groove of the first member; and joining the first member and the second member at joint peripheral portions of the first member and the second member at which the first member and the second member are joined with each other, by heating the first member and the second member from outside the fitted second member, and upon forming the first member and the second member, a channel groove through which the fluid flows is formed in at least one of a bottom portion of the fitting groove of the first member and a facing surface of the second member facing the bottom portion, and the joint peripheral portions of the first member and the second member are joined to form the channel defined by the channel groove.

With such a structure, the channel is formed at a portion which is in the bottom portion of the fitting groove of the first member and is closed by a lower portion of the second member, and a portion which is in the joint peripheral portion between the first member and the second member and is relatively distant from the channel is welded. Moreover, since the second member has the shape that fits the fitting groove of the first member, a component melted by heating does not enter the channel, which can prevent the occurrence of variation in channel sectional area, that is, variation in channel resistance. Further, the channel groove can be arbitrarily formed in advance, and therefore, by welding the first member and the second member, it is possible to easily form even a channel whose layout is complicated. Further, if the first member and the second member are made of members with low flexibility, it is possible to prevent the first member and the second member from deforming due to a pressure change in the channel, which can prevent a change in channel sectional area.

According to a second aspect of the present invention, there is provided a channel forming body forming a channel for a fluid, the channel forming body including: a first member having a fitting groove; and a second member having an outer shape which is fittable in the fitting groove and which is fitted in the fitting groove, and a channel groove is formed in at least one of a bottom portion of the fitting groove of the first member and a facing surface of the second member facing the bottom portion, a gap between an inner sidewall surface of the fitting groove of the first member and a sidewall surface of the second member is sealed, and the channel through which the fluid flows is formed by the channel groove.

With such a structure, it is possible to realize the channel forming body that is capable of preventing a channel sectional area from easily changing due to a pressure change in the channel.

According to a third aspect of the present invention, there is provided assembly parts of a channel forming body forming a channel for a fluid, the assembly parts including: a first member having a fitting groove; and a second member which is to be fitted into the fitting groove, and a channel groove is formed in at least one of a bottom portion of the fitting groove of the first member and a facing surface, of the second member, which faces the bottom portion of the fitting groove when the second member is fitted in the fitting groove, the channel groove forming the channel through which the fluid flows in a state that the second member is fitted in the fitting groove.

With such a structure, by using the forming method described above, it is possible to easily form the channel which is capable of preventing variation and change in channel resistance and whose layout is complicated.

According to the present invention, it is possible to provide a channel forming method, a channel forming body, and an assembly part of the channel forming body which are capable of preventing variation in channel resistance and easily ensuring airtightness.

BRIEF DESCRIPTION OF THE DRAWINGS

FIG. 14A and FIG. 14B are tables showing the results of the comparison between a resistance value of the second channel according to this embodiment and a resistance value of a channel according to a comparative example formed by heat-welding a film to a resin member.

DETAILED DESCRIPTION OF THE PREFERRED EMBODIMENTS

Hereinafter, a channel forming method, a channel forming body, and assembly parts (assembly kit) of the channel forming body according to an embodiment of the present invention will be explained with reference to the drawings, taking, as an example, the structure when they are applied to an ink-jet printer apparatus (hereinafter, referred to as a "printer apparatus") having a jetting head. Note that in the following explanation, a downward direction refers to a direction in which the jetting head jets ink, an upward direction refers to an opposite direction thereof, a scanning direction of the jetting head is used as synonymous with a right and left direction, and a front and rear direction refers to a direction perpendicular to both the upward and downward direction and the right and left direction.

Figure 1:
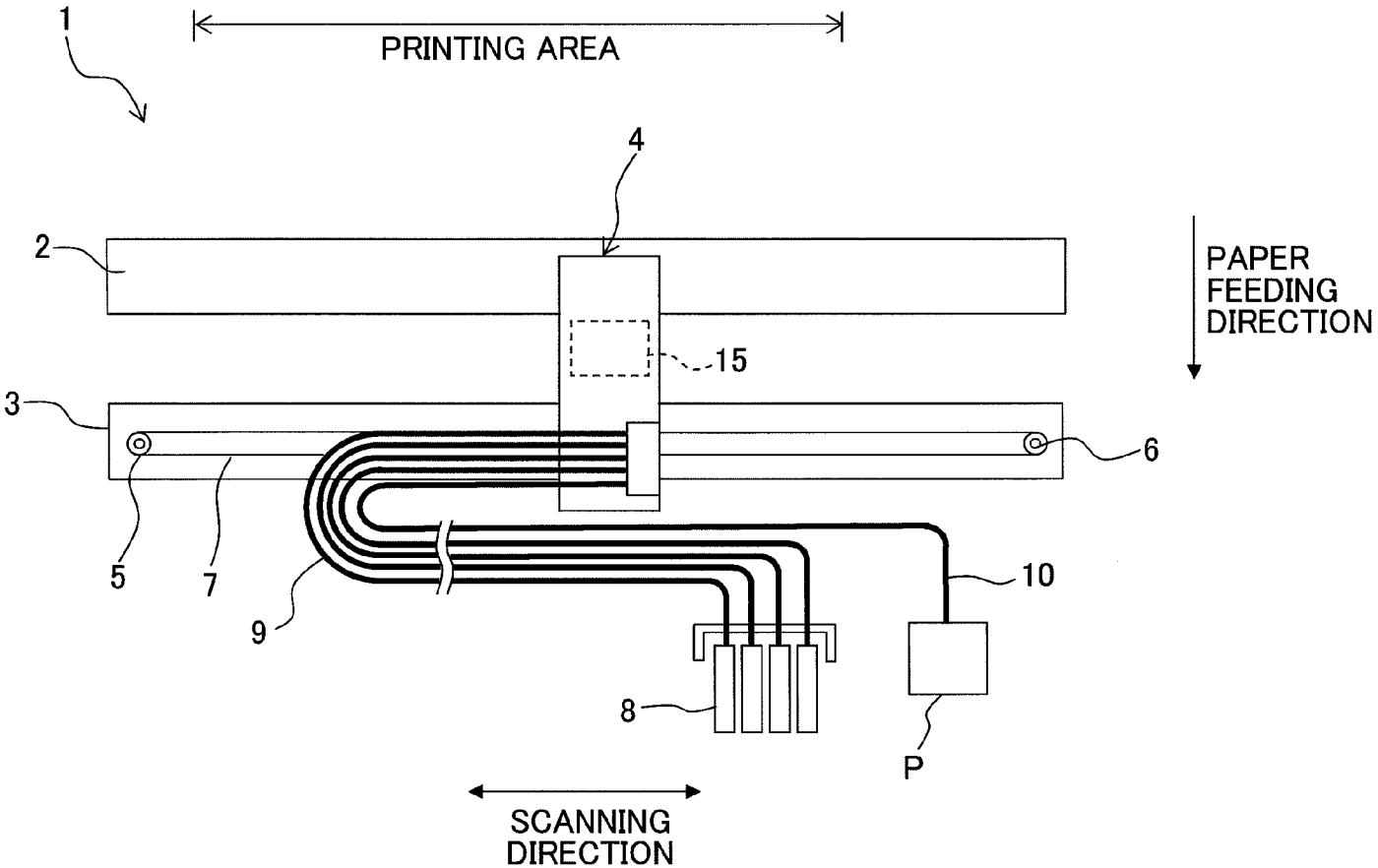
FIG. 1 is a schematic plane view showing an essential part of a printer apparatus including a damper unit according to an embodiment of the present invention.

As shown in FIG. 1, in the printer apparatus 1, a pair of guide rails 2, 3 extending in the right and left direction are disposed substantially in parallel to each other and a liquid supply unit 4 is supported by the guide rails 2, 3 to be slidable in the scanning direction. A pair of pulleys 5, 6 are provided near right and left end portions of the guide rail 3, and the liquid supply unit 4 is joined to a timing belt 7 wound around the pulleys 5, 6. In the pulley 6, a motor (not shown) for forward and inverse rotary driving is provided, and when the pulley 6 is driven for forward and inverse rotation, the timing belt 7 is capable of reciprocating in the left direction and the right direction. The liquid supply unit 4 reciprocates for scanning in the right and left direction along the guide rails 2, 3, accordingly.

In the printer apparatus 1, four ink cartridges 8 are mounted so as to be detachable for replacement. Four ink supply tubes 9 having flexibility are connected to the liquid supply unit 4 so that four color inks (black, cyan, magenta, yellow) can be supplied from the ink-cartridges 8 respectively. On a lower side of the liquid supply unit 4, a jetting head 15 (see FIG. 2 as well) is mounted, and the jetting head 15 jets the inks (liquid) toward a recording medium (for example, a recording paper) which is carried under the jetting head 15 in a direction (paper feed direction) perpendicular to the scanning direction, so that an image can be formed on the recording medium.

Figure 2:
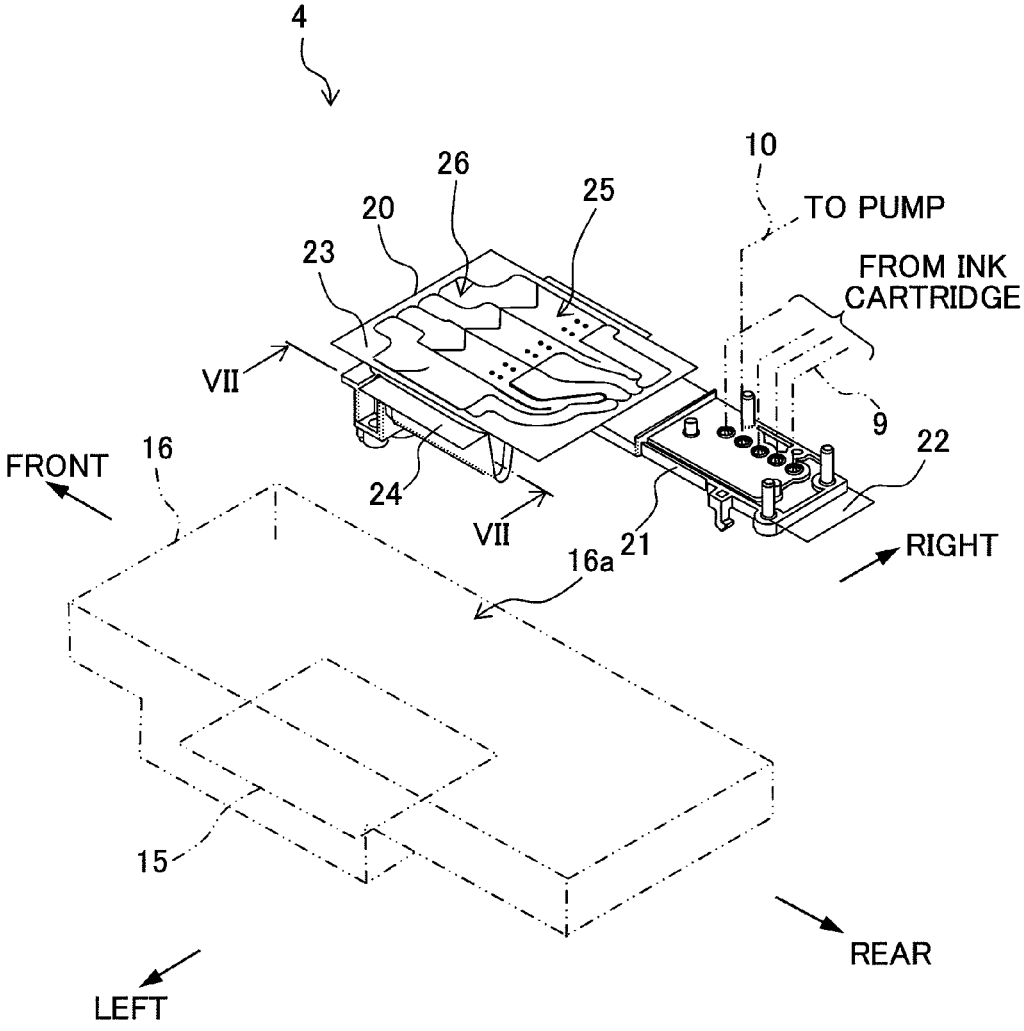
FIG. 2 is an exploded perspective view showing the structure of a liquid supply unit included in the printer apparatus shown in FIG. 1.

As shown in FIG. 2, the liquid supply unit 4 includes: a carriage case 16 supporting the jetting head 15; and a damper unit 20 mounted in the carriage case 16 above the jetting head 15. The carriage case 16 is in a substantially rectangular shape which is long in the front and rear direction in a plane view and is in a box shape having an opening 16*a* on its upper side. The damper unit 20 is mounted via the opening 16*a*.

The damper unit 20 is structured such that a plurality of films 22 to 24 in a rectangular sheet form are heat-welded to a substrate 21 which is a resin-molded product and is long in the front and rear direction, and the aforesaid ink supply tubes 9 and an air discharge tube 10 (see FIG. 1 as well) are connected to a rear portion of the substrate 21. Further, in a front portion of the damper unit 20, a damper device 25 for alleviating a pressure change of the inks is provided, and in further front thereof, a sub tank 26 temporarily storing the inks is provided. The inks supplied to the damper unit 20 via the ink supply tubes 9 pass through the damper device 25 and the sub tank 26 to be supplied to the jetting head 15. The structure of the damper unit 20 will be described in more detail below.

Figure 4A:
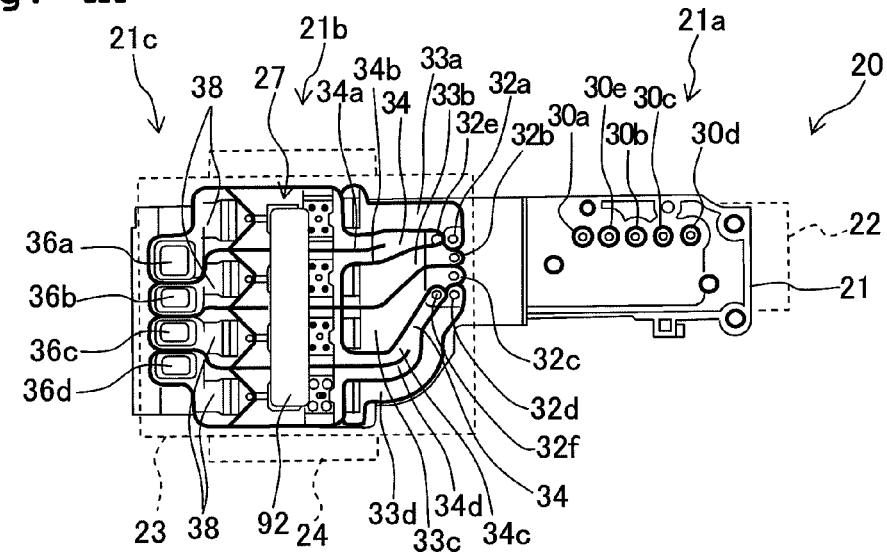
FIG. 4A is a plane view of the damper unit.
Figure 4B:
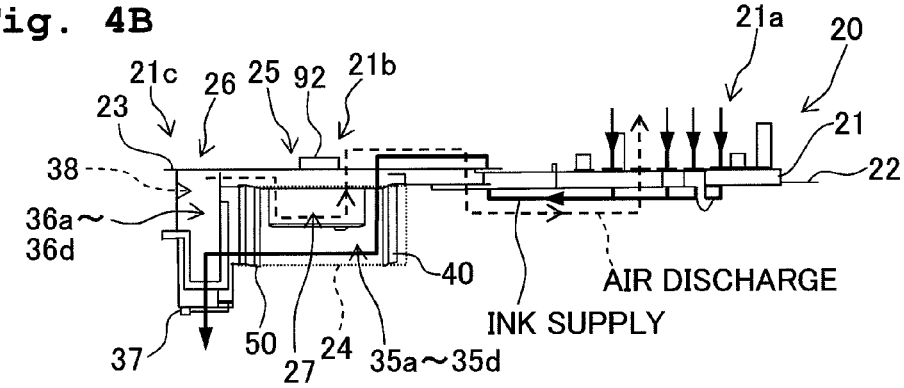
FIG. 4B is a side view of the damper unit.
Figure 4C:
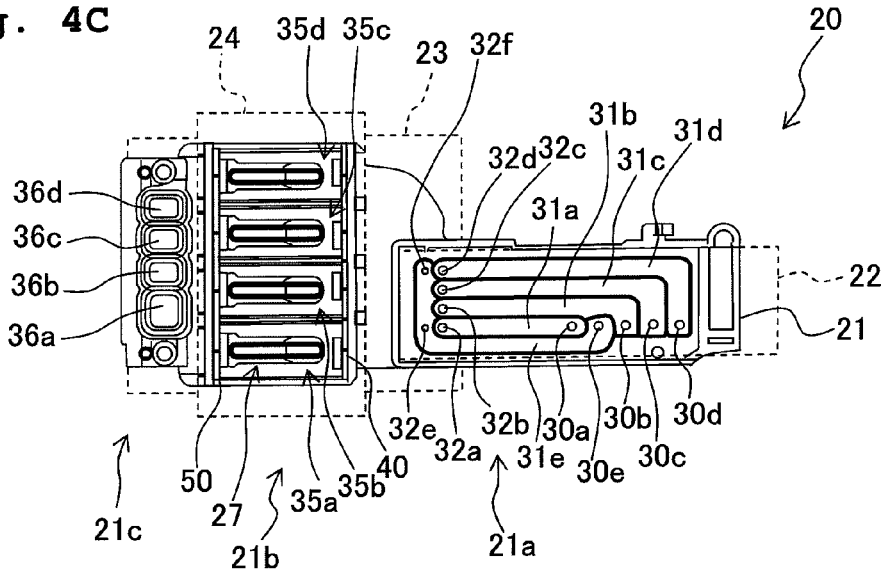
FIG. 4C is a bottom view of the damper unit.

As shown in FIG. 4A to FIG. 4C, the substrate 21 that the damper unit 20 has includes a channel forming portion 21*a* located in a rear portion, a damper forming portion 21*b* located in front thereof, and a tank forming portion 21*c* located in further front thereof, and the channel forming portion 21*a* is smaller in right and left-direction width than the damper forming portion 21*b* and the tank forming portion 21*c*.

As shown in FIG. 4A to FIG. 4C, in a portion close to one side of the rear portion in the channel forming portion 21*a*, four supply tube connection holes 30*a* to 30*d* and one air discharge tube hole 30*e* which are formed to penetrate in the up and down direction are arranged close to each other so as to be in a line in the front and rear direction. Further, in a front end portion of the channel forming portion 21*a*, four supply bypass holes 32*a* to 32*d* and two air discharge bypass holes 32*e*, 32*f* are formed to penetrate in the up and down direction, the former holes 32*a* to 32*d* being arranged in a line in the right and left direction and the latter holes 32*e*, 32*f* being also arranged in a line in the right and left direction. The ink supply tubes 9 extending from the ink cartridges 8 are connected to the supply tube connection holes 30*a* to 30*d*, and the air discharge tube 10 extending from a pump P provided in the printer apparatus 1 is connected to the air discharge tube connection hole 30*e* (see FIG. 1 and FIG. 2).

As shown in the bottom view of FIG. 4C, five grooves in a concave shape recessed upward are formed on a bottom surface side of the channel forming portion 21*a*, and the bottom surface of the channel forming portion 21*a* is covered by the film 22, so that four ink guide channels 31*a* to 31*d* extending from the supply tube connection holes 30*a* to 30*d* up to the supply bypass holes 32*a* to 32*d* and one air discharge guide channel 31*e* extending from the air discharge tube connection hole 30*e* up to the air discharge bypass holes 32*e*, 32*f* are formed.

As shown in the plane view of FIG. 4A, in an upper surface of the damper forming portion 21*b* of the substrate 21, grooves in a concave shape communicating individually with the four bypass holes 32*a* to 32*d* are formed, and upper surfaces of the damper forming portion 21*b* and the tank forming portion 21*c* are covered by the film 23 (see FIG. 3) which is a flexible member, so that ink connection channels 33*a* to 33*d* extending forward are formed. The ink connection channels 33*a* to 33*d* communicate respectively with upper portions of four ink storage chambers 35*a* to 35*d* formed in a front portion of the damper forming portion 21*b* and arranged side by side in the right and left direction.

Further, between the adjacent ink connection channels 33*a*, 33*b*, a groove in a concave shape communicating with the air discharge bypass hole 32*f* is formed, and between the ink connection channels 33*c*, 33*d*, a groove in a concave shape communicating with the air discharge bypass hole 32*e* is formed. These grooves are also covered by the film 23, so that air discharge connection channels 34, 34 extending forward are formed. Out of these, the air discharge connection channel 34 extending from the air discharge bypass hole 32*f* branches off in the middle into two air discharge connection channels 34*c*, 34*d*, which communicate with an air discharge mechanism 27 (to be described later). Similarly, the air discharge connection channel 34 extending from the air discharge bypass hole 32*e* branches off in the middle into two air discharge connection channels 34*a*, 34*b*, which communicate with the air discharge mechanism 27.

Figure 3:
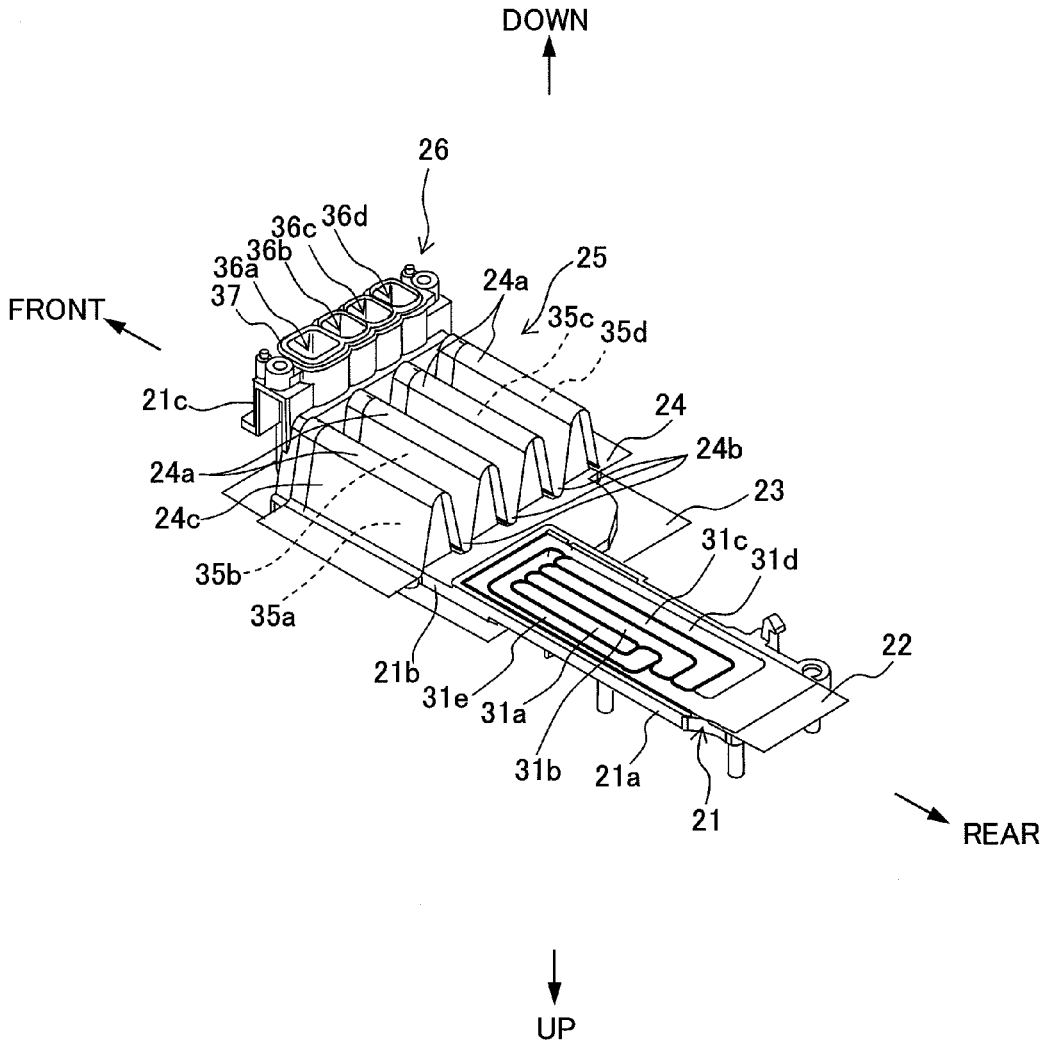
FIG. 3 is a perspective view of the damper unit, seen from under, mounted in the liquid supply unit shown in FIG. 2.

As shown in FIG. 3, the ink storage chambers 35*a* to 35*d* are covered by the films 23, 24 from the up and down directions to form the damper device 25. As for each of the ink storage chambers 35*a* to 35*d*, a cross section thereof perpendicular to the front and rear direction is in a substantially inverse triangular shape and the whole shape thereof is a substantially triangular prism shape extending in the front and rear direction. The ink storage chambers 35*a* to 35*d* are arranged side by side in order from one side to another side of the damper forming portion 21*b*.

In front of the ink storage chambers 35*a* to 35*d*, the sub tank 26 composed of four tank chambers 36*a* to 36*d* formed in the tank forming portion 21*c* is provided. The tank chambers 36*a* to 36*d* are arranged in a line in order from one side to another side of the tank forming portion 21*c*, and upper sides thereof together with the ink storage chambers 35*a* to 35*d* are covered by the film 23. Upper spaces of the ink storage chambers 35*a* to 35*d* communicate with upper spaces of the corresponding tank chambers 36*a* to 36*d* so that the inks can flow therebetween, and upper portions of these spaces foam air storage portions 38 (see FIG. 4A to FIG. 4C) temporarily storing air. Further, as shown in FIG. 3, on a lower side of the sub tank 26, a sealing member 37 (see FIG. 5 as well) in which four holes communicating with the tank chambers 36*a* to 36*d* is attached, and when the damper unit 20 is mounted in the carriage case 16 (see FIG. 2), a lower end of the sealing member 37 is connected to the jetting head 15.

As shown by the solid line arrow in FIG. 4B, in the above-described damper unit 20, liquid supply channels from the supply tube connection holes 30*a* to 30*d* to the sealing member 37 are formed. In the liquid supply channels, the inks from the ink supply tubes 9 are supplied from an upper surface side of the substrate 21, and the inks are guided to the supply bypass holes 32*a* to 32*d* via the ink guide channels 31*a* to 31*d* on a lower surface side of the substrate 21. Then, the inks pass through the ink connection channels 33*a* to 33*d* on the upper surface side of the substrate 21 via the supply bypass holes 32*a* to 32*d* to flow into the respective ink storage chambers 35*a* to 35*d* of the damper device 25. Then, the inks in the ink storage chambers 35*a* to 35*d* are guided to the respective tank chambers 36*a* to 36*d* whose upper portions communicate with the ink storage chambers 35*a* to 35*d*, flow to the lower side of the tank chambers 36*a* to 36*d*, and are supplied to the jetting head 15 (see FIG. 2) connected via the sealing member 37.

During this period, when pressure of the inks changes because of the scanning of the liquid supply unit 4 or the like, the pressure change is alleviated by the damper device 25, and the air growing in the inks is stored in the air storage portions 38 provided in the middle of the liquid supply channels and is discharged to the outside via the air discharge mechanism 27 at a predetermined timing (see the broken-line arrow shown in the side view of FIG. 4B). Hereinafter, the structure of the damper device 25 will be first explained, and thereafter, the structure of the air discharge mechanism 27 will be explained in detail.

Figure 5:
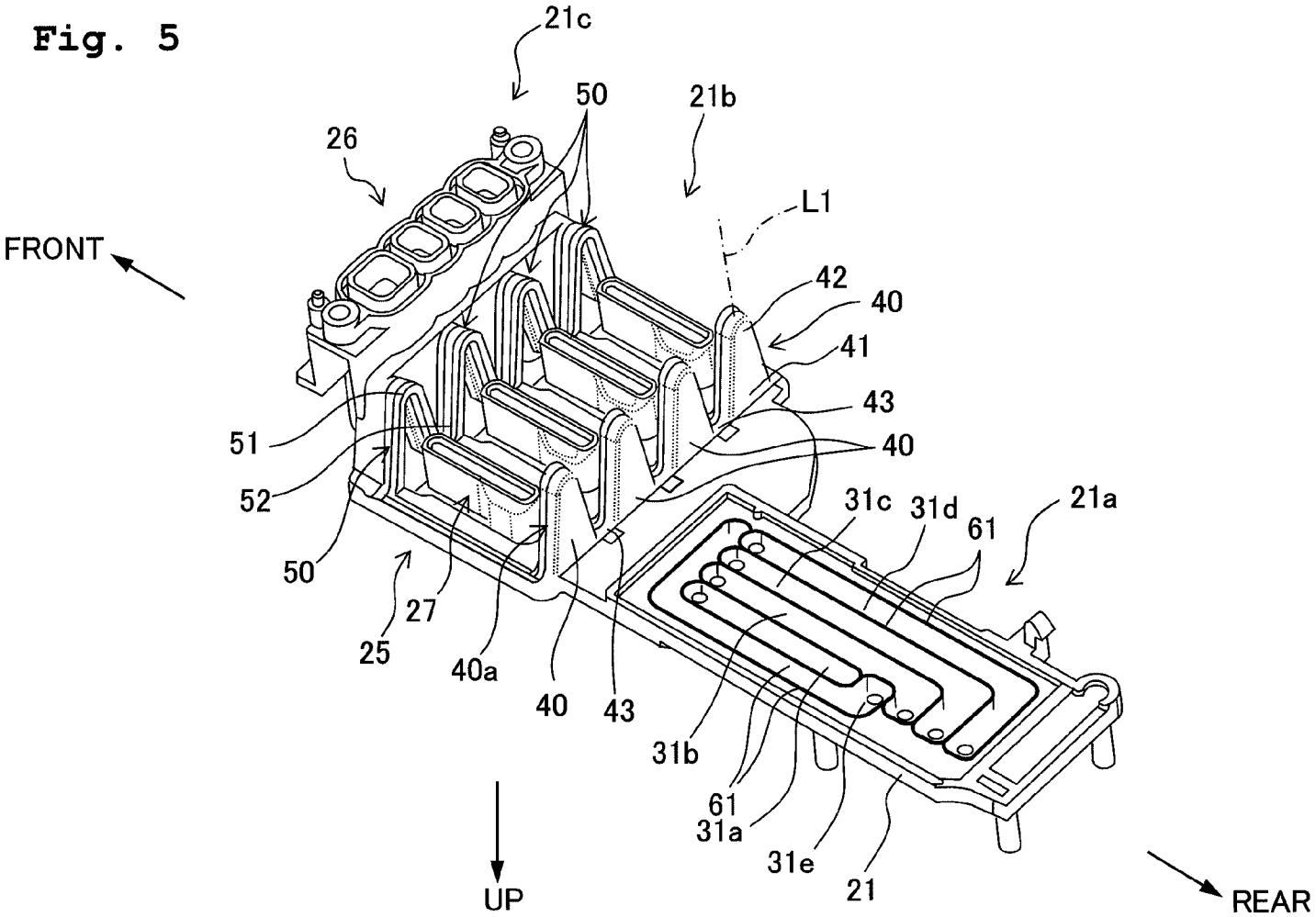
FIG. 5 is a view used to explain the structure of a damper device and is an exploded perspective view when a substrate is seen from under.
Figure 6:
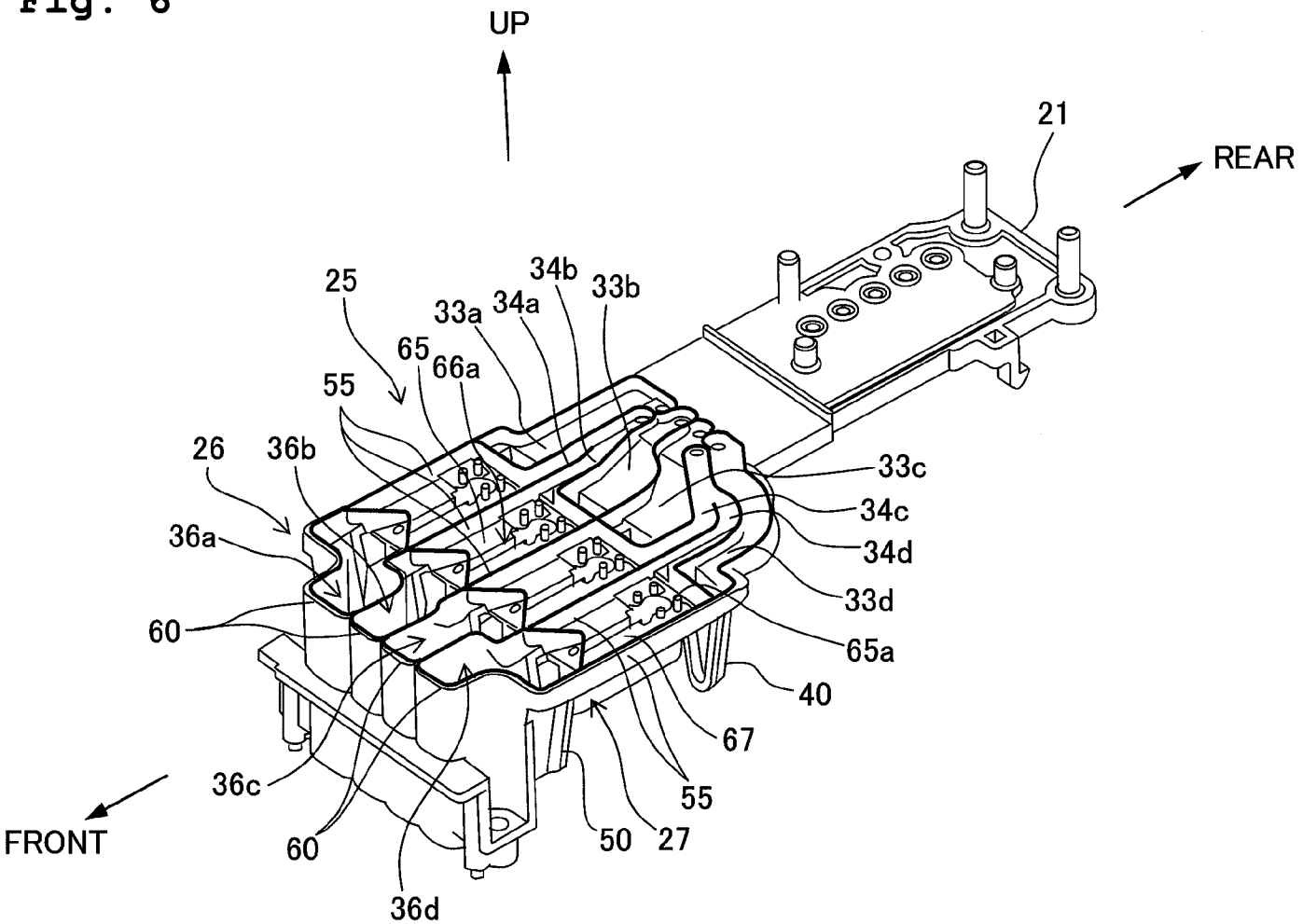
FIG. 6 is a perspective view when the substrate shown in FIG. 5 is seen from above.

As shown in FIG. 5 and FIG. 6, on a lower surface of the damper forming portion 21*b* of the substrate 21 forming the damper unit 20, four elastic walls 40 in a substantially triangular shape are projectingly provided. The elastic walls 40 are arranged in a line in the right and left direction so that their normal direction becomes the front and rear direction, and in front of the elastic walls 40, four support edge portions 50 are provided to face the elastic walls 40 respectively and to be equally distant from the elastic walls 40. In other words, on the lower surface of the damper foaming portion 21*b*, the elastic walls 40 and the support edge portions 50 making pairs are disposed to face each other in the front and rear direction. Four such pairs each composed of the elastic wall 40 and the support edge portion 50 are arranged side by side in the right and left direction.

As shown in FIG. 5, the elastic walls 40 all have the same shape. Each of the elastic walls 40 is in a substantially triangular shape in which a base portion 41 connected to the substrate 21 forms a base and a tip portion most distant from the substrate 21 forms a vertex 42, and has a shape laterally symmetrical with respect to a virtual line L1 in the up and down direction connecting the base portion 41 and the vertex 42. Further, the vertexes 42 are rounded so as to form an arc shape projecting upward in a rear view, and in each gap between the base portions 41, 41 of the adjacent elastic walls 40, a concave connection portion 43 in an arc shape recessed downward is formed. The support edge portions 50 have substantially the same contour shape as that of peripheral portions 40*a* of the aforesaid elastic walls 40 and have vertexes 51 and concave connection portions 52 similar to the vertexes 42 and the concave connection portions 43.

Between each of the concave connection portions 43, which are provided between the adjacent elastic walls 40, and each of the concave connection portions 52, which are provided between the corresponding support edge portions 50, a bridging rib 55 (see FIG. 6) extending in the front and rear direction is provided, and between outer end portions of the base portions 41 of the elastic walls 40 located at right and left ends and end portions of the corresponding support edge portions 50, similar bridging ribs 55 (see FIG. 6) are also provided. Therefore, in this embodiment, the four elastic walls 40 and the four support edge portions 50 are coupled by the totally five bridging ribs 55.

As shown in FIG. 6, on the upper surface of the substrate 21, a connection edge portion 60 connected to the film 23 is formed along peripheral upper surfaces of the ink connection channels 33*a* to 33*d* and the air discharge connection channels 34*a* to 34*d*, upper surfaces of the bridging ribs 55, and upper surfaces of wall portions defining the tank chambers 36*a* to 36*d*, and the connection edge portion 60 is formed so as to be located in substantially the same plane over the whole length. Further, as shown in FIG. 5, a connection edge portion 61 connected to the film 22 is also formed on the lower surface of the substrate 21 along peripheral upper surfaces of the ink guide channels 31*a* to 31*d* and the air discharge guide channel 31*e*, and the connection edge portion 61 is also formed so as to be located in substantially the same plane over the whole length.

In this embodiment, the film 24 being a flexible member in a rectangular sheet form is heat-welded in a predetermined procedure to the elastic walls 40, the support edge portions 50, and the bridging ribs 55 which are described above, and the film 23 is heat-welded to the connection edge portion 60 on the upper surface of the substrate 21. Consequently, the damper device 25 having the ink storage chambers 35*a* to 35*d* surrounded by the films 23, 24, the elastic walls 40, and the support edge portions 50 is formed (see FIG. 3), and at the same time, the sub tank 26 having the tank chambers 36*a* to 36*d* is formed. Further, the film 22 is heat-welded also to the connection edge portion 61 on the lower surface of the substrate 21, and consequently, the ink guide channels 31*a* to 31*d* and the air discharge guide channel 31*e* are formed.

In the damper device 25 formed in this manner, each of the ink storage chambers 35*a* to 35*d* is in a substantially triangular prism shape extending in the front and rear direction which is the arrangement direction of the elastic wall 40 and the support edge portion 50 which make a pair. A cross section of each of the ink storage chambers 35*a* to 35*d* perpendicular to its axial direction (that is, the arrangement direction of the elastic wall 40 and the support edge portion 50 making a pair), at any point on the axis, has a triangular shape (an inverse triangular shape in the posture at the time of use shown in FIG. 2). Further, the ink storage chambers 35*a* to 35*d* are formed as spaces of which peripheral surfaces defined by the film 24 are in a curved shape. Concretely, as shown in FIG. 3, on portions connecting the vertexes 42, 51 of the elastic walls 40 and the support edge portions 50, ridge portions 24*a* with an arc-shaped cross section whose peripheral surfaces are defined in a curved shape by the film 24 are formed. Further, on portions connecting the concave connection portions 43, 52, valley portions 24*b* with an arc-shaped cross section of which peripheral surfaces are defined in a curved shape by the film 24 are formed. Out of these, the valley portions 24*b* are fixed to the bridging ribs 55 by welding to prevent the color inks in the adjacent ink storage chambers 35*a* to 35*d* from mixing, while the ridge portions 24*a* are not welded to the substrate 21 and so on so as to be capable of exhibiting flexibility.

Therefore, when a negative pressure is generated in such a damper device 25 due to a change in the pressure in the ink storage chambers 35*a* to 35*d*, sidewall surfaces 24*c* (see FIG. 3), of the film 24, between the ridge portions 24*a* and the valley portions 24*b* and the ridge portions 24*a* deform to bend inward, so that the volumes of the ink storage chambers 35*a* to 35*d* change three dimensionally. Since the film 24 is made of a flexible member, such deformation of the film 24 is highly responsive to the pressure change and high damper performance can be exhibited. Further, in accordance with the deformation of the film 24, the vertexes 42 of the elastic walls 40 also bend inward relative to the base portions 41, and when the negative pressure is cancelled, elasticity of the elastic walls 40 allows the film 24 to quickly return to the original state.

Figure 7:
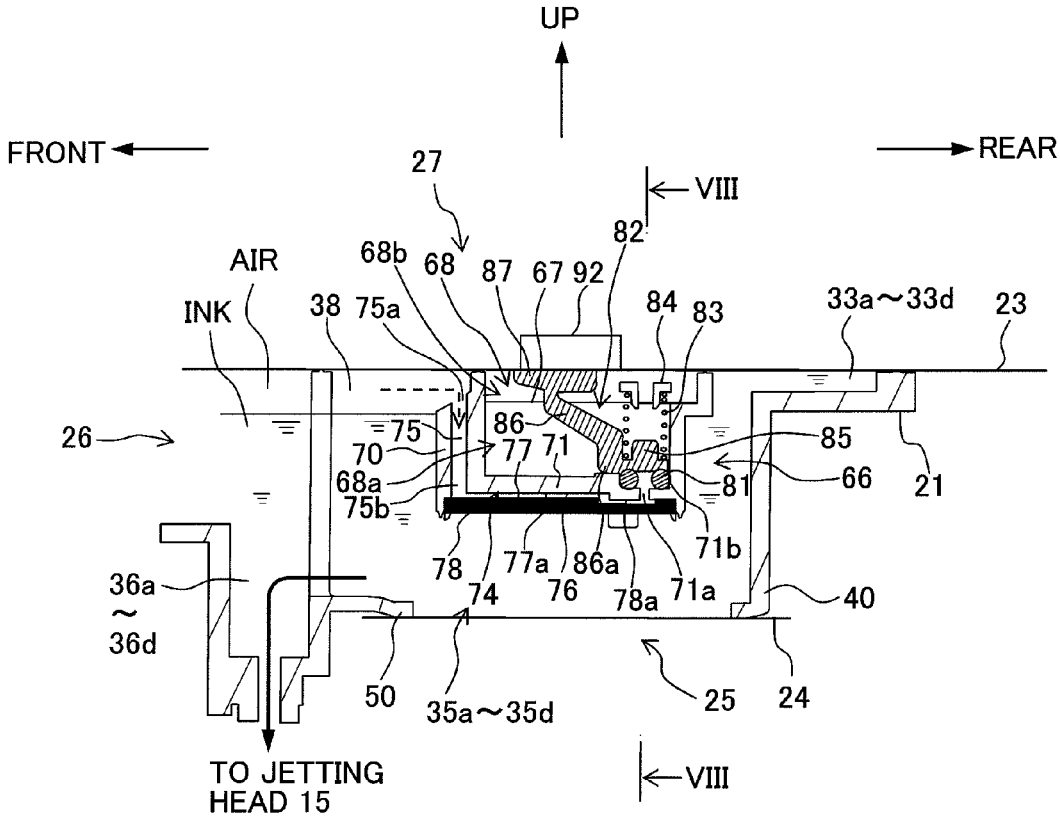
FIG. 7 is a view showing the structure of an air discharge mechanism and is a cross-sectional view taken along VII-VII line in FIG. 2.

As shown in FIG. 7, the air discharge mechanism 27 is located above the damper device 25, and choke channels 74 (to be described later) formed in the air discharge mechanism 27 sink in the ink storage chambers 35*a* to 35*d*.

Figure 8:
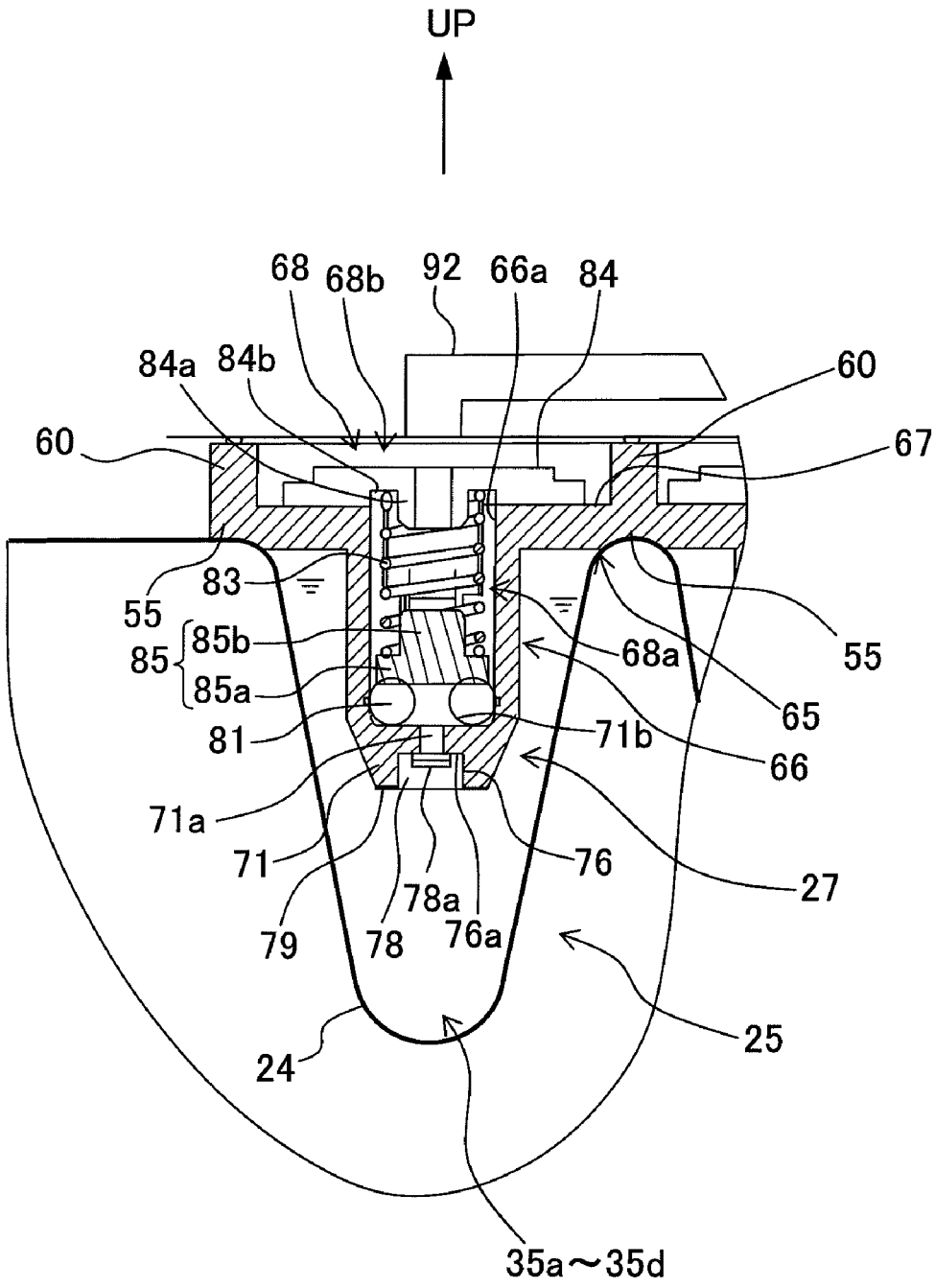
FIG. 8 is a view showing the structure of the air discharge mechanism and is a cross-sectional view taken along VIII-VIII line in FIG. 7.

The air discharge mechanism 27 will be described in detail. As shown in FIG. 8, between the adjacent bridging ribs 55, 55 among the bridging ribs 55 provided on the substrate 21, a partition plate 65 closing an upper portion of a corresponding one of the ink storage chambers 35*a* to 35*d* is provided, and at a center portion between the adjacent bridging ribs 55, 55 in the right and left direction, the partition plate 65 has a bulging portion 66 bulging out toward the corresponding one of the ink storage chambers 35*a* to 35*d* thereunder. Further, on an upper portion of the bridging rib 55, the connection edge portion 60 already explained is projectingly provided, and the film 23 being a flexible member is welded to the upper surface of the connection edge portion 60, whereby a valve chamber 68 surrounded by the film 23 and the partition plate 65 is formed. The valve chamber 68 is composed of a narrow first chamber 68*a* formed in the bulging portion 66 and a wide second chamber 68*b* which is located above the first chamber 68*a* and upper side of which is closed by the film 23, and the chambers 68*a*, 68*b* communicate with each other via an opening 66*a* of the bulging portion 66.

As shown in FIG. 7, the air discharge mechanism 27 includes the choke channels 74 each provided along a front wall portion 70 and a bottom wall portion 71 of the bulging portion 66 so as to allow the air storage portion 38, which is already explained, and the valve chamber 68 to communicate with each other (see FIG. 8 as well). More concretely, as shown in FIG. 7, the front wall portion 70 of the bulging portion 66 has a double-wall structure and has a first channel 75 extending in the up and down direction. An upper opening 75*a* of the first channel 75 is open so as to communicate with the air storage portion 38 at an upper portion of the corresponding one of the ink storage chambers 35*a* to 35*d*, and an opening surface thereof is inclined toward the air storage portion 38 to face upward and forward, so that air in the air storage portion 38 can be easily guided into the first channel 75.

Further, a center portion of the bottom wall portion (first member) 71 of the bulging portion 66 in the right and left-direction is recessed upward, whereby a fitting groove 76 extending in the front and rear direction is formed. Further, in a bottom surface 76*a* (see FIG. 8) of the fitting groove 76, that is, in the surface 76*a* facing downward in the fitting groove 76 opening downward as shown in FIG. 8, a channel groove 77*a* extending forward from a center portion of a longitudinal direction is formed, and a lower opening 75*b* of the first channel 75 communicates with a front end portion of the channel groove 77*a*. Further, a fitting member (second member) 78 which is long in the front and rear direction is fitted into the fitting groove 76 from under, and on a rear upper surface of the fitting member 78, another channel groove 78*a* extending in the front and rear direction is formed. When the fitting member 78 is fitted into the fitting groove 76, the channel grooves 77*a*, 78*a* communicate with each other, whereby a second channel 77 extending from a front end portion up to a rear end portion of the bottom wall portion 71 of the bulging portion 66 is formed.

By the second channel 77 and the first channel 75 formed in the above-described manner, the choke channel 74 in an L-shape in a side view is formed as shown in FIG. 7, and the choke channel 74 communicates with the first chamber 68*a* in the bulging portion 66 via a communication hole 71*a* formed in a rear portion of the bottom wall portion 71. Incidentally, in FIG. 8, in a state that the fitting member 78 is fitted into the fitting groove 76, a film 79 is further welded from under, thereby ensuring airtightness of the second channel 77 of the choke channel 74, but the second channel 77 with the above structure has high airtightness and thus the film 79 is not necessarily required. Further, the above-described second channel 77 forming the choke channel 74 will be described in more detail later (see FIGS. 12A to 12B to FIG. 14).

Figure 9:
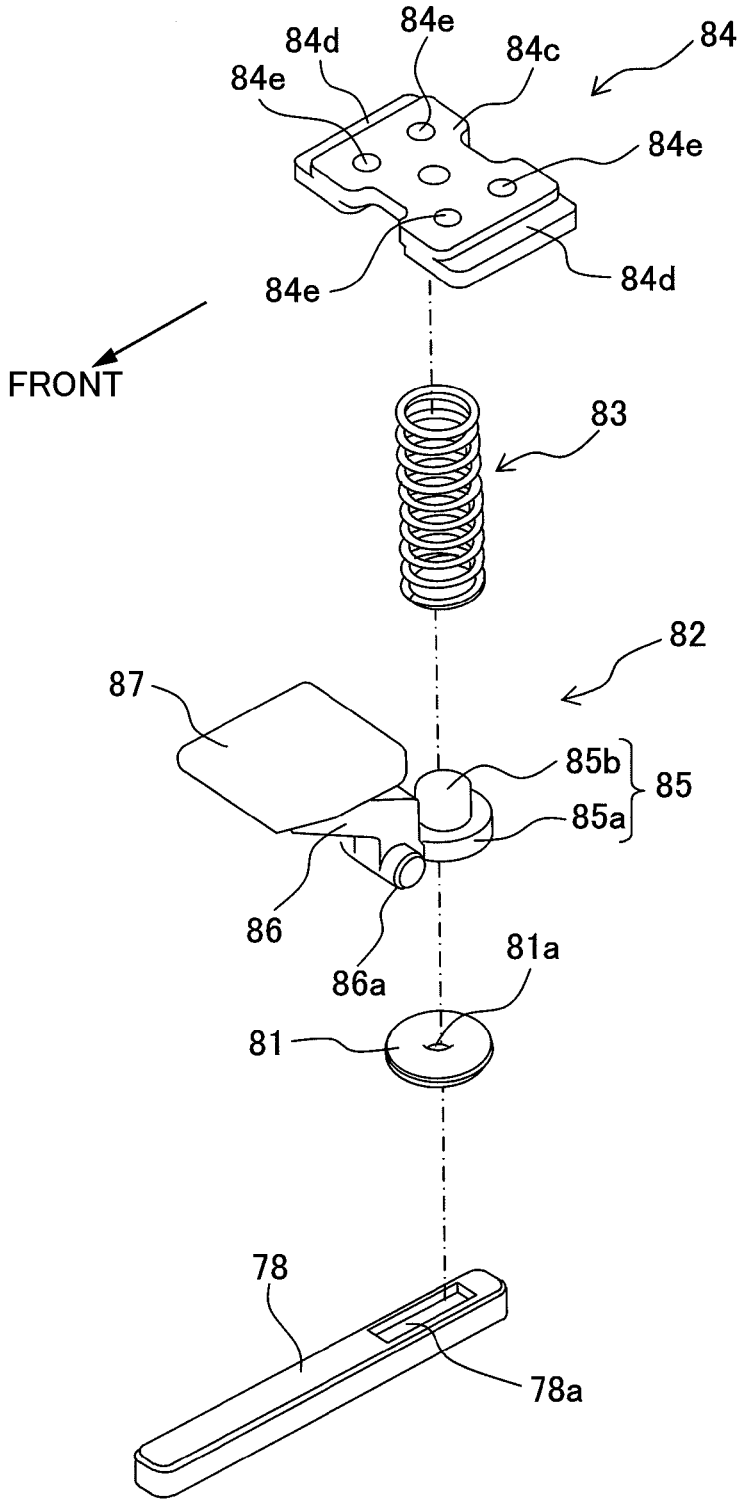
FIG. 9 is an exploded perspective view showing an essential part of the air discharge mechanism.

In the valve chamber 68, a valve unit 80 is housed to open/close the communication hole 71*a* communicating with the choke channel 74. As shown in FIG. 9, the valve unit 80 is composed of a sealing member 81 made of an annular rubber member, a valve element 82 opening/closing the communication hole 71*a*, a coil spring 83 biasing the valve element 82 in a closing direction, and a spring support plate 84 supporting the coil spring 83.

As shown in FIG. 7, in a rear upper surface of the bottom wall portion 71 of the bulging portion 66, a concave portion 71*b* recessed downward is formed. The communication hole 71*a* is opened at a bottom center of the concave portion 71*b*, and the annular sealing member 81 is housed in the concave portion 71*b* so that the center of its center hole 81*a* (see FIG. 9) substantially coincides with the center of the communication hole 71*a*.

As shown in FIG. 9, the valve element 82 has: a valve portion 85 which abuts on an upper portion of the sealing member 81 so as to cover the center hole 81*a* and thereby is capable of closing the communication hole 71*a*; and an arm portion 86 extending from the valve portion 85. The valve portion 85 is in a stepped columnar shape with its upper portion smaller in diameter than its lower portion, and a bottom surface of the lower portion 85*a* is formed flat so as to be in close contact with the upper portion of the sealing member 81. The arm portion 86 extends from the lower portion 85*a*, and on a base portion of the arm portion 86 (near a connection portion with the lower portion 85*a* of the valve portion 85), a pivot support portion 86*a* projecting downward and having an arc-shaped contour in a side view is formed. The pivot support portion 86*a* abuts on an upper surface of the bottom wall portion 71 of the bulging portion 66 (see FIG. 7), and the valve element 82 is capable of pivoting with respect to the pivot support portion 86*a*.

Further, the arm portion 86 extends from the valve portion 85 forward and upward in the first chamber 68*a* and in the middle, bends upward to reach the second chamber 68*b*, and on its tip, an abutting portion 87 abutting from under on the film 23 covering an upper portion of the valve chamber 68 is provided. As shown in FIG. 9, the abutting portion 87 has a substantially rectangular shape in a plane view, and is larger in width than the first chamber 68*a* and its upper surface is flat, thereby having a large contact surface with the film 23. Incidentally, a portion, of the partition plate 65, connecting the bridging rib 55 and the bulging portion 66 forms a restricting portion 67 in a horizontal plate shape (see FIG. 8), and when the valve element 82 pivots with respect to the pivot support portion 86*a*, the abutting portion 87 comes into contact with the restricting portion 67, so that a pivot range of the abutting portion 87 in an opening-direction is restricted.

As shown in FIG. 8, around an outer surface of the upper portion 85*b* of the valve portion 85, the coil spring 83 provided coaxially in the up and down direction is set from above, and an upper end of the coil spring 83 is supported by the spring support plate 84. The spring support plate 84 has a rectangular parallelepiped shape in a plane view, and on its lower surface center portion, a cylindrical projecting portion 84*a* is provided to project downward, and further, a circumferential groove 84*b* recessed upward is formed so as to surround the projecting portion 84*a*. Further, as shown in FIG. 9, an upper surface of the spring support plate 84 is structured such that its right and left end portions are one-step lower than its center portion, that is, the upper surface is composed of an upper step surface 84*c* formed at the center portion and lower step surfaces 84*d* formed on the right and left thereof. In the upper step surface 84*c*, four caulking holes 84*e* penetrating the spring support plate 84 in the up and down direction are formed at front, rear, right, and left positions.

As shown in FIG. 8, such a spring support plate 84 is connected to the upper surface of the partition plate 65 with its projecting portion 84*a* being set in the coil spring 83 from above. At this time, four caulking members 65*a* (see FIG. 6) projectingly provided on an upper surface of the restricting portion 67 of the partition plate 65 are inserted through the four caulking holes 84*e* of the spring support plate 84 and further a caulking cover (not shown) is put over the caulking holes 84*e* from above, whereby the spring support plate 84 is fixed to the upper surface of the partition plate 65. In this manner, the coil spring 83 is housed in a compressed state between the spring support plate 84 and the valve portion 85 and biases the valve portion 85 downward so as to close the communication hole 71*a*.

Figure 10A:
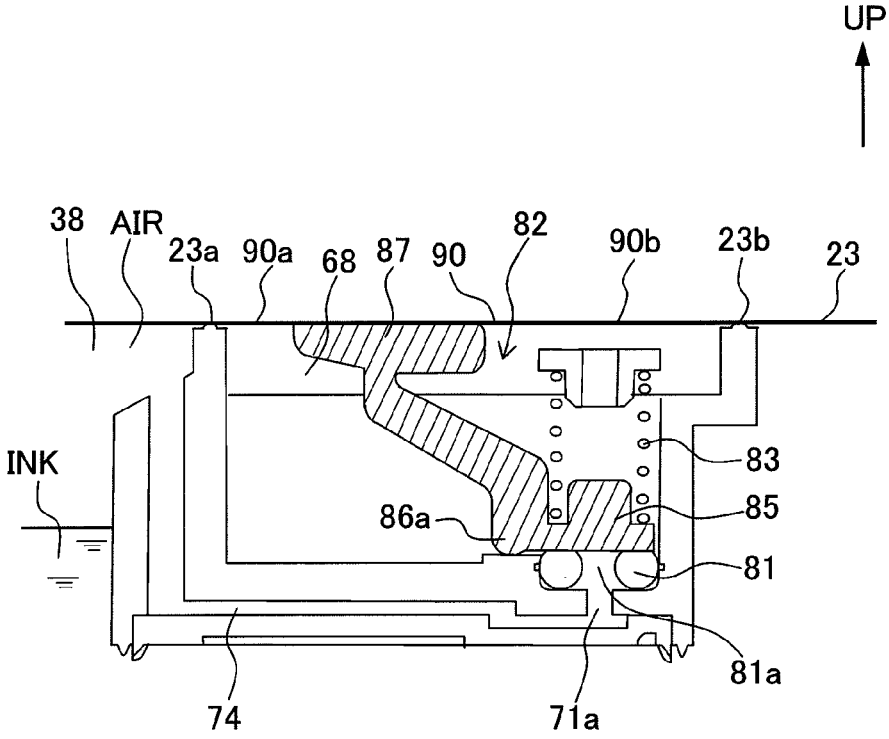
FIG. 10A and FIG. 10B are views used to explain the operation of the air discharge mechanism, FIG. 10A showing a state where a valve chamber has an atmospheric pressure and FIG. 10B showing a state where the valve chamber has a negative pressure.

As shown in FIG. 10A, when the valve chamber 68 has an atmospheric pressure, the valve portion 85 of the valve element 82 is biased downward by the coil spring 83, and the lower portion 85*a* of the valve portion 85 abuts on the upper portion of the sealing member 81. As a result, its center hole 81*a* and the communication hole 71*a* are closed, so that the valve chamber 68 and the air storage portion 38 are insulated from each other.

Figure 10B:
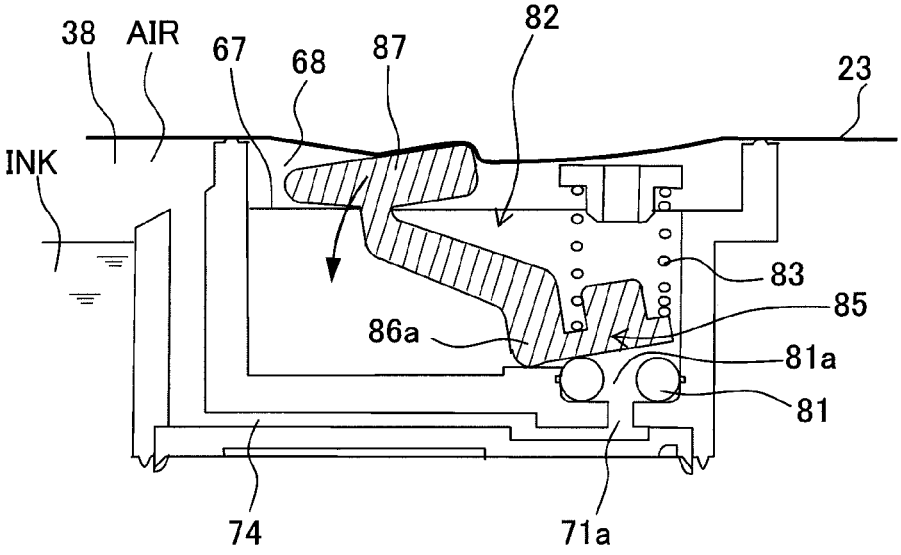
Figure 11:
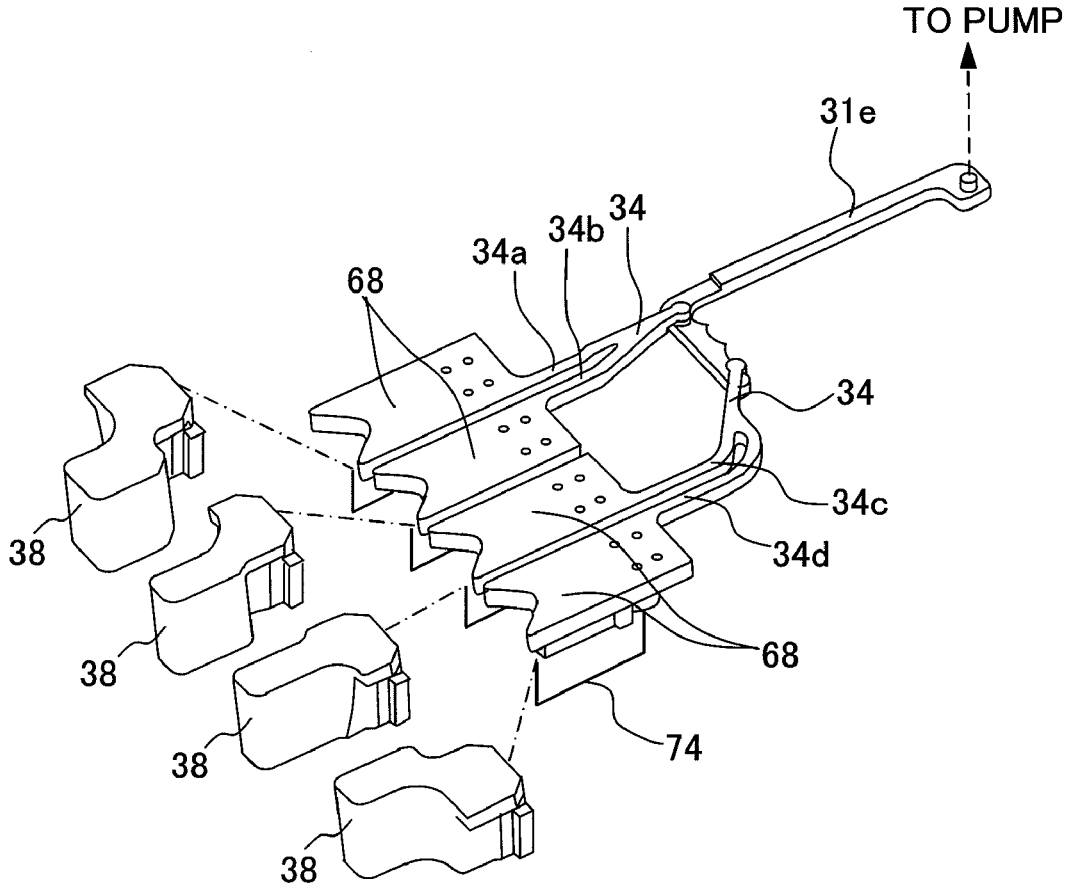
FIG. 11 is a perspective view showing an air discharge route, in the substrate, from air storage portions up to an air discharge tube connection hole.

When air is sucked by the pump P (see FIG. 1) via the air discharge tube 10, the negative pressure is transmitted to the valve chamber 68 via the air discharge guide channel 31*e* and a corresponding one of the air discharge connection channels 34*a* to 34*d* (see FIG. 4 as well) which are shown in FIG. 11. Then, as shown in FIG. 10B, the film 23 being a flexible member deforms downward to press the abutting portion 87 downward and the valve element 82 pivots with respect to the pivot support portion 86*a*. Consequently, the valve portion 85 displaces upward, and its lower portion 85*a* separates from the sealing member 81 to make a gap, and accordingly, the valve chamber 68 communicates with the air storage portion 38 via the center hole 81*a* of the sealing member 81, the communication hole 71*a*, and the choke channel 74.

In this state, when the negative pressure is continuously generated by the pump P, the air in the air storage portion 38 is led to the valve chamber 68 through the choke channel 74. This air passes through the corresponding one of the air discharge connection channels 34*a* to 34*d* and the air discharge guide channel 31*e* and is further discharged to outside through the air discharge tube 10. As a result, it is possible to discharge the air in the air storage portion 38, which makes it possible to increase the volume of the ink that can be stored in the ink storage chambers 35*a* to 35*d* and the tank chambers 36*a* to 36*d* and further makes it possible to continue to store the air in the ink in the air storage portion 38.

Figure 12A:
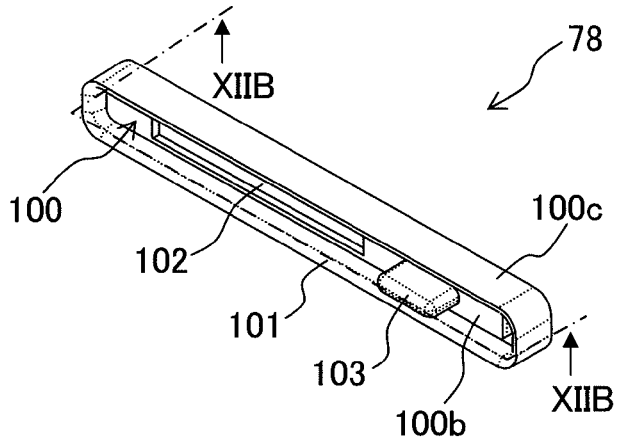
FIG. 12A to FIG. 12C are views showing the structure of an assembly part forming a second channel of a choke channel, FIG. 12A being a perspective view of a fitting member (second member) seen from diagonally under, FIG. 12B being a cross-sectional view taken along XIIB-XIIB line in FIG. 12A, and FIG. 12C being an enlarged cross-sectional view of the vicinity of a fitting groove in a bottom wall portion (first member) of a bulging portion.
Figure 12B:
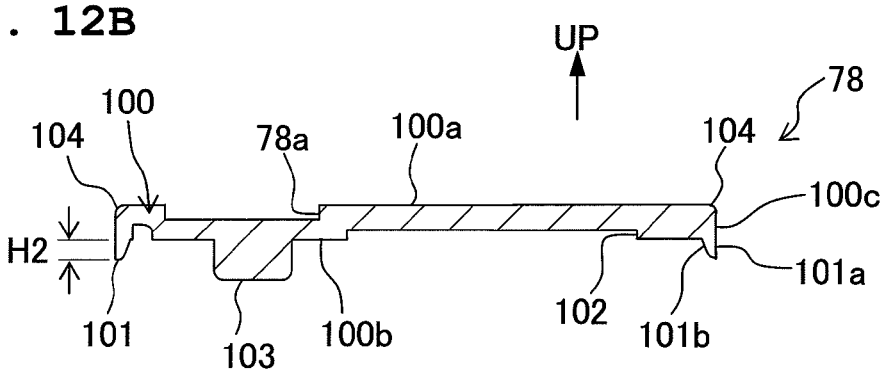

Next, assembly parts (assembly kit) forming the second channel 77 of the choke channel 74 will be explained. The assembly kit forming the second channel 77 includes: the bottom wall portion (hereinafter, referred to as a "first member") 71 of the bulging portion 66 having the fitting groove 76; and the fitting member (hereinafter, referred to as a "second member") 78 which is to be fitted into the fitting groove 76. As shown in FIG. 12A and FIG. 12B, the second member 78 has a base portion 100 in a plate shape which is long in the front and rear direction, and in an upper surface 100*a* (facing surface facing the bottom portion of the fitting groove, see FIG. 12B) of the base portion 100, the channel groove 78*a* previously explained is formed. On an outer peripheral portion of a lower surface 100*b* (exposed surface which is exposed, to outside, at an opening of the fitting groove when the second member is fitted into the fitting groove) of the base portion 100, a second projection 101 with a height H2 projecting downward is formed along the outer peripheral portion. As shown in FIG. 12B, a cross section of the second projection 101 has a right triangular shape having a side substantially flush with a sidewall surface 100*c* of the base portion 100. Therefore, the second projection 101 has a vertical outer wall surface 101*a* substantially flush with the sidewall surface 100*c* and an inclined inner wall surface 101*b* meeting the vertical outer wall surface 101*a* at an acute angle, and has a right triangular prism shape extending along the outer peripheral portion of the base portion 100. Therefore, in a state that the second member 78 is fitted into the first member 71, the second projection 101 comes close to a joint peripheral portion 116, and by melting the second projection 101, it is possible to surely join the joint peripheral portions 116 of the first member 71 and the second member 78.

Further, the lower surface 100*b* of the base portion 100 has, in its inner portion surrounded by the second projection 101, a concave portion 102 recessed upward. The concave portion 102 extends from one end portion to a center portion along a longitudinal direction of the base portion 100, and its cross section perpendicular to its longitudinal direction is in the same rectangular shape at any point in the longitudinal direction. Further, the lower surface 100*b* of the base portion 100 has a thin plate-shaped convex portion 103 provided at a position which is in its inner portion surrounded by the second projection 101 and is under the channel groove 78*a* on the other end portion side of the aforesaid concave portion 102. The convex portion 103 is a rectangular plate member which is long in the longitudinal direction of the base portion 100 in a side view, and its lower end extends up to a position under the second projection 101. This structure enables an operator to grip the convex portion 103 when the second member 78 is fitted into the fitting groove 76 of the first member 71, which can prevent the second projection 101 from being deformed by being touched during an insertion operation. Incidentally, the convex portion 103 can be melted at the time of the heat welding similarly to the second projection 101 and so on. Further, along an outer peripheral portion of the upper surface 100*a* of the base portion 100, a tapered portion 104 with a rounded corner at which the upper surface 100*a* and the sidewall surface 100*c* meet each other is formed. In this embodiment, the second member 78 as described above is formed by die molding by using synthetic resin melting at a predetermined temperature, and when in normal use where it is assembled in the printer apparatus 1, it can exhibit certain rigidity.

Figure 12C:
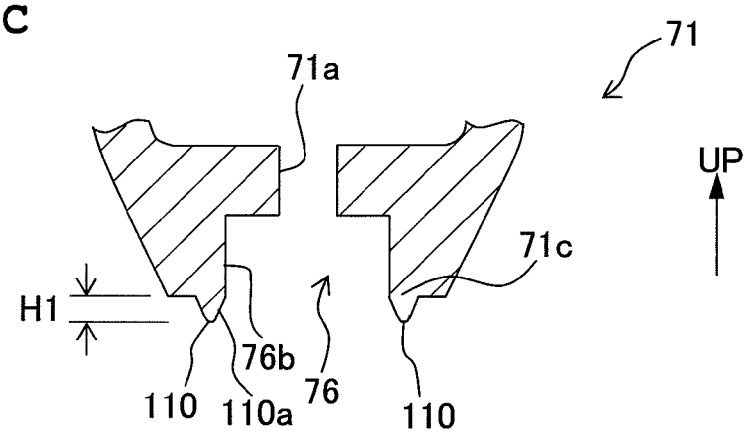

As shown in FIG. 12C, the fitting groove 76 opening downward is formed in the first member 71, and the fitting groove 76 has a shape that fits the aforesaid second member 78. On an opening edge portion 71*c* of the fitting groove 76 in the first member 71, a first projection 110 projecting downward is formed along the opening edge portion 71*c*. A cross section of the first projection 110 has a triangular shape having a side which extends from a lower end of an inner sidewall surface 76*b* (opening edge of the fitting groove) of the fitting groove 76 so as to be inclined in a direction in which the diameter of the opening of the fitting groove 76 extends (direction from inside the fitting groove to an inner sidewall surface of the fitting groove, the right and left direction in the cross-sectional view in FIG. 12C). In other words, the first projection 110 is in a triangular prism shape having an inclined inner wall surface 110*a* which extends from an upper end of the inner sidewall surface 76*b* of the fitting groove 76 so as to be inclined relative to the inner sidewall surface 76*b* in the direction in which the diameter of the opening of the fitting groove 76 extends. Therefore, when the second member 78 is fitted into the fitting groove 76 of the first member 71, it is possible to prevent the second member 78 from being hooked on the first projection 110, and consequently, the second member 78 having the shape which is fittable into the fitting groove 76 can be fitted into the fitting groove 76. A height H1 of the first projection 110 is set smaller than the height H2 of the second projection 101. Since this makes it possible to press the second projection 101 by a heater at the time of the welding or joining, it is possible to prevent the positional displacement of the second member 78 due to reasons such as its floating up from the fitting groove 76 during the welding or joining. Incidentally, such a first member 71 is also formed by die molding by using synthetic resin melting at a predetermined temperature, and in normal use where it is assembled in the printer apparatus 1, it can exhibit certain rigidity.

Figure 13A:
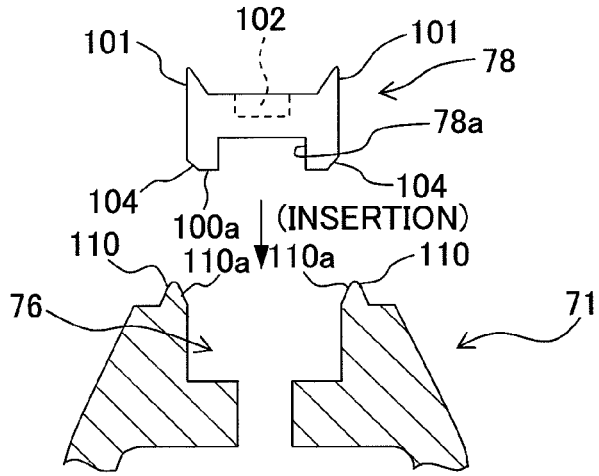
FIG. 13A to FIG. 13C are views showing processes of forming the second channel by fittingly inserting the second member into the fitting groove formed in the first member.
Figure 13B:
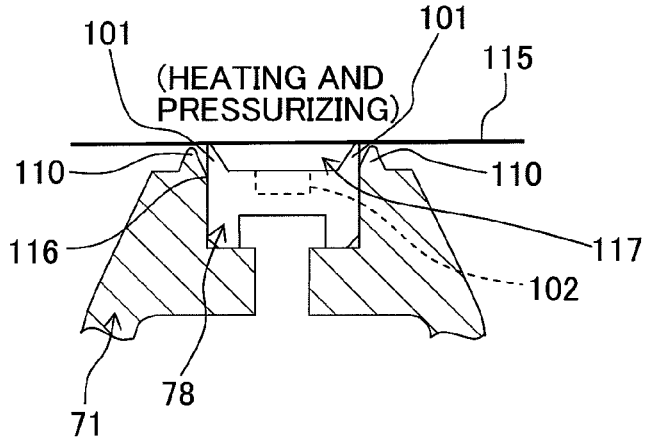
Figure 13C:
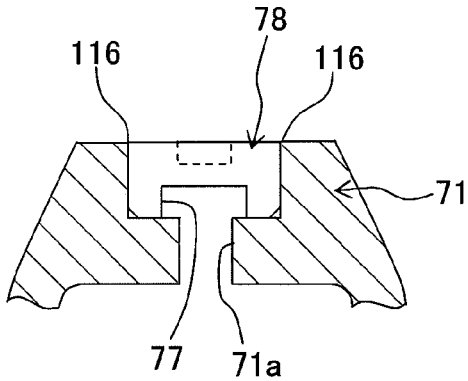

As shown in FIG. 13A to FIG. 13C, the second member 78 is fitted into the fitting groove 76 of such a first member 71, whereby the second channel 77 is formed. Processes for the above will be concretely explained. As shown in FIG. 13A, the second member 78 is brought from above close to the fitting groove 76 of the first member 71 which is turned upside down so as to open upward, and the second member 78 is fitted into the fitting groove 76. At this time, the second member 78 is also in an upside-down posture, and an operator grips the convex portion 103 (see FIG. 12) from above. Further, in the second member 78, along the outer peripheral portion of the surface 100*a* facing the fitting groove 76, the tapered portion 104 is formed, and the first projection 110 of the first member 71 has the inclined inner wall surface 110*a*, which facilitates fitting the second member 78 into the fitting groove 76 of the first member 71.

Next, as shown in FIG. 13B, in the state that the second member 78 is fitted up to the deepest portion of the fitting groove 76, a sheet 115 made of polyimide resin or the like is put over the first member 71 and the second member 78, and the first member 71 and the second member 78 are pressed downward while being heated from above by the heater (not shown) via the sheet 115. Consequently, the first projection 110 and the second projection 101 both melt, so that the joint peripheral portions 116 of the first member 71 and the second member 78 (that is, a contact portion between the sidewall surface 76*b* of the first member 71 and the sidewall surface 100*c* of the base portion 100 that the second member 78 has) are joined to be closed by molten contents. In this manner, in the channel forming body formed by the first member and the second member 78, the second channel 77 is formed so as to be sandwiched by the first member 71 and the second member 78 as shown in FIG. 13C. Incidentally, in this embodiment, as shown in FIG. 7, the second channel 77 is formed as being bent in a cranked shape by the long channel groove (first channel groove) 77*a* formed in the first member (bottom wall portion) 71 side and the short channel groove (second channel groove) 78*a* formed in the second member (fitting member) 78 side.

Here, since the projection amount H2 of the second projection 101 is greater than the projection amount H1 of the first projection 110 (H1<H2), the second projection 101 first comes into contact with the heater to be pressed downward. Therefore, it is possible to prevent the second member 78 from floating upward from the fitting groove 76 when the first member 71 and the second member 78 are heated and joined with each other. Further, the sheet 115 can prevent the molten contents of the first projection 110 and the second projection 101 from adhering to the heater.

Further, at the time of the heating and pressurizing the first projection 110 and the second projection 101, since the sheet 115 is put over, a space 117 surrounded by the second projection 101 in the second member 78 becomes a closed space, and the temperature and pressure in the space 117 become high. However, since the second member 78 according to this embodiment has the concave portion 102, a relatively large volume is reserved for this space 117 and the increase in temperature and pressure is alleviated. Further, due to this concave portion 102, the base portion 100 becomes thin, which makes it possible to reduce the deformation of the second member 78 due to what is called sinkage at the time of cooling after the heating is finished.

Incidentally, in this embodiment, the structure where the first projection 110 and the second projection 101 are both provided is explained, but only one of these may be provided if it is possible for the molten content of the first projection 110 or the second projection 101 to join and close the joint peripheral portions 116 of the first member 71 and the second member 78. Further, if the same condition is satisfied, the vertical outer wall surface 101*a* of the second projection 101 may be inclined inward, or the first projection 110 and the second projection 101 may be provided to be slightly apart from the sidewall surface 100*c* and the inner sidewall surface 76*b*.

This embodiment is an example in which the present invention is applied to the air discharge channel of the printer apparatus. However, it is not limited to the air discharge channel of the printer apparatus, and the present invention is applicable to a channel for a fluid which is required high airtightness and less variation in channel resistance. Further, the fluid which flows through the channel is not restricted to gas such as air, and liquid may flow through the channel.

According to the channel forming method using the first member 71 and the second member 78 explained in the foregoing, since the molten contents of the first projection 110 and the second projection 101 which are melted at the time of the heating adhere to the joint peripheral portions 116 of the first member 71 and the second member 78, it is possible to surely join the joint peripheral portions 116 of the first member 71 and the second member 78. The molten contents of the first projection 110 and the second projection 101 join the both members 71, 78 especially at a position apart from the second channel 77. Therefore, it is possible to ensure high airtightness to the outside of the second channel 77. Further, since the molten contents are difficult to enter the second channel 77, a desired channel sectional area can be obtained accurately, which can prevent variation in channel resistance. Further, since the first member 71 and the second member 78 are made of synthetic resin and have certain rigidity, it is possible to prevent the channel sectional area from changing due to the pressure of air flowing inside. Furthermore, since it is possible to control a melting amount at portions of the joint peripheral portion 116 to a constant value, an improvement in welding precision can be realized.

As shown in FIGS. 14A and 14B, the second channel 77 according to this embodiment is composed of the long groove formed by the channel groove 77*a* and the short groove formed by the channel groove 78*a*, and a channel according to a comparative example is set to have the same structure. However, in the comparative example, a tolerance of depth includes not only a tolerance (±0.03 mm) of a component itself but also a tolerance (±0.1 mm) due to a welding amount unique to heat welding, and is a sum value (±0.13 mm) of these tolerances. Further, in the case of the comparative example, the deformation of a film due to an inner pressure is not taken into consideration.

When a laminar flow passes through such a second channel 77 according to this embodiment and the channel according to the comparative example, a pressure loss occurs due to the friction between the fluid and a channel inner wall, and a theoretical value of the pressure loss is given by the following expression (1) generally known as a Hagen-Poiseuille expression. Here, in applying the Hagen-Poiseuille expression to a channel having a rectangular cross section, an equivalent radius (also called a hydraulic diameter) was calculated in order to replace each of the channels with an equivalent circular channel. Then, the pressure loss was divided by a flow rate expressed by $\{\pi(D/2)^2 \cdot u\}$, whereby the resistance values shown in FIG. 14 were calculated.

$$\Delta P = 32\mu L u / D^2 \quad (1)$$

where ΔP is pressure loss, μ is viscosity, L is representative length, u is average velocity of the fluid, and D is hydraulic diameter.

As a result, in the second channel 77 according to this embodiment, a difference between the maximum value and the minimum value of the resistance is 25.86 [kPa/(ml/s)], while in the channel according to the comparative example, the difference is 196.81 [kPa/(ml/s)], which shows that the second channel 77 according to this embodiment is extremely smaller in resistance than the channel with the same shape and dimension having the heat-welded film.

What is claimed is:

1. A channel forming body forming a channel for a fluid, the channel forming body comprising:

a first member having a fitting groove; and a second member having an outer shape which is fittable in the fitting groove and which is fitted in the fitting groove, wherein a channel groove is formed in at least one of a bottom portion of the fitting groove of the first member and a facing surface of the second member facing the bottom portion, a gap between an inner sidewall surface of the fitting groove of the first member and a sidewall surface of the second member is sealed, with the inner sidewall surface of the fitting groove of the first member contacting the sidewall surface of the second member, and the channel through which the fluid flows is formed by the channel groove, and wherein the first member has a first channel groove formed in the bottom portion of the fitting groove of the first member, the second member has a second channel groove formed in the facing surface of the second member, and the channel is formed as being bent in a cranked shape by the first channel groove and the second channel groove.

2. Assembly parts of a channel forming body forming a channel for a fluid, the assembly parts comprising:

a first member having a fitting groove; and a second member which is to be fitted into the fitting groove, wherein a channel groove is formed in at least one of a bottom portion of the fitting groove of the first member and a facing surface, of the second member, which faces the bottom portion of the fitting groove when the second member is fitted in the fitting groove, the channel groove forming the channel through which the fluid flows in a state that the second member is fitted in the fitting groove, and wherein a first projection is formed on the first member at an opening edge portion of the fitting groove to project in an opening direction of the fitting groove and to be melted during assembly of the assembly parts.

3. The assembly parts of the channel forming body according to claim 2, wherein a cross section of the first projection, orthogonal to a peripheral direction of the fitting groove, has a triangular shape having a side extending from an opening edge of the fitting groove and inclined in a direction from inside the fitting groove to an inner sidewall surface of the fitting groove.

4. The assembly parts of the channel forming body according to claim 2, wherein the second member has an exposed surface which is exposed, to outside, at an opening of the fitting groove when the second member is fitted into the fitting groove; and a second projection is formed on the second member at an outer peripheral portion of the exposed surface to project from the exposed surface and to be melted during assembly of the assembly parts.

5. The assembly parts of the channel forming body according to claim 4, wherein the second projection has a side surface which is substantially flush with a sidewall surface of the second member, and a cross section of the second projection, orthogonal to an outer peripheral direction of the exposed surface, has a triangular shape.

6. The assembly parts of the channel forming body according to claim 4, wherein a projection amount of the second projection is greater than that of the first projection.

7. The assembly parts of the channel forming body according to claim 4, wherein in the exposed surface of the second member, a concave portion recessed from the exposed surface is formed at a portion surrounded by the second projection.

8. The assembly parts of the channel forming body according to claim 4, wherein on the exposed surface of the second member, a convex portion projecting from the exposed surface is formed at a portion surrounded by the second projection.

* * * * *